US005128236A

United States Patent [19]

Beighle et al.

[11] Patent Number: 5,128,236

[45] Date of Patent: Jul. 7, 1992

[54] DRYING WITH IMPROVED PHYSICAL PERFORMANCE OF PHOTOGRAPHIC FILMS

[75] Inventors: Patricia J. Beighle, Sayre, Pa.; Carl P. Beitelshees, Zirconia, N.C.; Daniel E. Jacober, Asheville, N.C.; Herbert W. Lim, Arden, N.C.

[73] Assignee: E. I. Du Pont de Nemours and Company, Wilmington, Del.

[21] Appl. No.: 544,438

[22] Filed: Jun. 27, 1990

[51] Int. Cl.[5] ..... G03C 5/26

[52] U.S. Cl. ..... 430/349; 430/546; 430/631; 430/935

[58] Field of Search ..... 430/349, 139, 546, 631, 430/935

[56] References Cited

U.S. PATENT DOCUMENTS 3,043,697 7/1962 Forsgard ..... 430/631

FOREIGN PATENT DOCUMENTS 63-257747 10/1988 Japan ..... 430/631

*Primary Examiner*—Charles L. Bowers, Jr.
*Assistant Examiner*—Janet C. Baxter

[57] ABSTRACT

A photographic, silver halide element that can be dried under rapid conditions during coating without deleterious effects on fog, kinks and other surface conditions, is described. This process can function with the addition of a small amount of a high boiling, aromatic alcohol to the emulsion prior to coating. Further improvements are noted with the addition of small amounts of a humectant and a plasticizer. The films resulting from this novel process can be handled without problems in the modern, automatic changing devices, for example.

4 Claims, No Drawings

DRYING WITH IMPROVED PHYSICAL PERFORMANCE OF PHOTOGRAPHIC FILMS

BACKGROUND OF THE INVENTION

1. Field of the Invention

This invention relates to the process of drying photographic films and to an element produced thereby. This invention also relates to a process for drying gelatino silver halide films such that improved throughput is achieved. More specifically, this invention relates to gelatino silver halide elements produced by the aforesaid process and having improved physical characteristics such as a reduced propensity to develop kinks.

2. Background of the Invention

Kinks are defects that are sometimes produced in sensitized, gelatino, silver halide photographic elements. These defects are common in the field of X-ray films since these elements are coated at a considerably higher emulsion coating weight. The kinks usually occur where the film has been bent and may be of the sensitized or desensitized variety. There are some references made in the prior art to the addition of plasticizers or other adjuvant compounds to a photographic, gelatino, silver halide emulsion in order to reduce the propensity of the films coated therefrom to produce kinks. Some of these compounds are said to reduce the sensitized kinks and other the desensitized kinks. None have proven fully useful in modern, high speed medical X-ray films that are coated at high speeds using modern equipment. Here there are other problems such as the ability of the equipment to fully dry the film without causing fog problems. During the coating process it is common practice to chill and set the emulsion right after application to the support followed by raising the temperature to dry said emulsion. After this step, it is also common to condition the film so as to reduce so-called "drying fog". This conditioning step takes additional time and equipment sometimes up to 15 to 50% of the total dryer length. This then limits the capacity of the coating equipment. This limit in capacity is inefficient and is becoming intolerable in modern film making factories. There is a pressing need to develop a system that can solve the problems of kinking in a sensitized element and can also assist in speeding up the drying process during manufacture without producing drying fog and thus increase product through-put.

It is also known to add humectants and plasticizers to photographic emulsions for a variety of reasons. These reasons include the reduction of fog and kink improvement. When some of these prior art ingredients are added, problems can occur. For example, the emulsion can become too pliable and soft and this can result in formation of other surface defects.

SUMMARY OF THE INVENTION

It is an object of this invention to improve the rate of drying during the manufacture of high speed, photographic silver halide elements. It is also an object of this invention to substantially reduce the surface defects and fog produced in said elements. These and yet other objects are achieved in a process for the drying of a photosensitive element having at least one photosensitive gelatino silver halide emulsion coated on a support, wherein after said layer is coated, said element is subject to elevated temperatures to effect said drying, the improvement comprising the addition before said drying step of an effective amount of a compound taken from the group consisting of (1) a high boiling, aromatic alcohol of the formula:

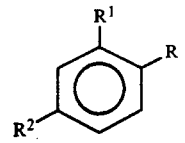

wherein R is —O—$CH_2$—$CH_2$—O—$R^4$, with $R^4$ being H; —$CH_2$—$CH_2$—OH; —$CH_2$—$CH_2$—O—$CH_2$—OH; or R is —O—Phenyl—OH, —O—$CH_2$—CHOH—$CH_2$OH or —O—$(CH_2)_4$—$CH_3$; $R^1$ is H or —O—$CH_3$; and $R^2$ is —OH or —$CH_3$;

(2) phenoxy-2-propanone;
(3) 2-methoxyethanol; and
(4) 2-ethoxyethanol;
(5) 2-phenoxyethanol;
(6) 2-(2-phenoxyethoxy) ethanol;
(7) 2-[2-(2-phenoxyethoxy)-ethoxy] ethanol;
(8) 3-phenoxy-1,2-propanediol;
(9) p-phenoxybenzyl alcohol;
(10) m-phenoxybenzyl alcohol; or
(11) 2-hydroxyethyl salicylate.

wherein a film element with reduced surface artifacts is produced.

In yet another, more preferred embodiment, the objects of this invention are achieved in a photographic, silver halide element comprising a support, at least one silver halide emulsion layer coated on said support, wherein said silver halide emulsion contains small amounts of the high boiling, organic alcohol, a plasticizer and a humectant.

DETAILS OF THE INVENTION

There are a host of high boiling, organic alcohols that can be used within the metes and bounds of this invention. These include the following:

A. 2-phenoxyethanol
B. 2-(2-phenoxyethoxy) ethanol
C. 2-[2-(2-phenoxyethoxy)-ethoxy] ethanol
D. 3-phenoxy-1,2-propanediol
E. m-phenoxybenzyl alcohol
F. p-phenoxybenzyl alcohol
G. phenoxy-2-propanone
H. 2-methoxyethanol
I. 2-ethoxyethanol
J. 2-hydroxyethyl salicylate These compounds may be added to a gelatino, silver halide emulsion prior to the coating thereof and will serve not only to reduce the time required to dry this emulsion but will produce reduced surface defects such as kinks.

The emulsions useful within the ambit of this invention may contain any of the conventional silver halides such as silver bromide, silver iodide and silver chloride, for example, or mixtures of two more of these halides. Generally, these silver halides are precipitated grains in small amounts of gelatin. These grains may be any of the conventional shapes (e.g., round, cubic, tabular, tetrahedral, dodecahedral, etc.). Then, the emulsion is further bulked up with gelatin and brought to its optimum sensitivity with gold and sulfur salts as is well-known in the prior art. Other sensitizing compounds, antifoggants, spectral sensitizing dyes, coating and wetting aids, hardeners, etc., may also be present depending on the need of that particular emulsion and the expected use. We prefer using high speed, gelatino silver iodobromide grains with small, thick tabular shapes or cubic or round shapes. These are commonly used for high speed, medical X-ray elements and are conventionally coated on both sides of a film support. This support is generally dimensionally stable, polyethylene terephthalate film base tinted with a small amount of a blue dye and subbed on both sides with resin and gel subs to enhance the adhesion of the aqueous emulsion thereto.

Generally, a thin gelatin antiabrasion layer is coated over the emulsion layer or layers to provide protection thereto. Then, the film support containing these layers is dried following a very specific drying scheme. In this scheme, the film is first chilled to set up the gelatin followed by passage through an area where the temperature is increased to dry film. Finally, it is then conventional to condition the film prior to accumulating the film on rolls. This final, conditioning step can occupy 20–50% of the total dryer length and is added only to insure that drying fog is minimized. Thus, using the teachings of this invention it is now possible to reduce this conditioning step significantly.

The aforesaid organic alcohols can be added to the emulsion anytime prior to coating but preferably after the sensitization step just prior to coating. They may be added dissolved in any solvent compatible with the aqueous emulsion such as water, lower alcohols such as methanol or ethanol, or acetone or any mixtures thereof. They may be added in an amount of 1 to 50 weight percent based on the total gelatin present in the emulsion. Preferably, they are added at 5 to 30 weight percent and still more preferably at 6 to 15 weight percent.

In the present invention there are two benefits which can be directly realized by the addition of the defined compound, i.e., the defined alcohol. As previously discussed the addition of the compound results in reduced surface artifacts compared to a similar emulsion without the addition of the compound.

Additionally, the present invention allows drying under harsher conditions which would otherwise introduce a substantial amount of fog. Such drying denotes an increase throughput can be realized since a lower relative humidity (RH) can be employed in a drier. Illustratively it is conventional to employ about 60% RH to remove the last 15 to 50% by weight water from a coating. In the present invention, 50 to 100% by weight of water removal can be undertaken at a RH in a range of 5 to 30%. Preferably, at least 90% by weight of the water is removed.

The present process with the introduction of the compound in the photosensitive gelatin silver halide emulsion can result in a reduction of at least 0.02 fog compared to the same emulsion without the compound but dried under the same conditions. A more preferred value is at least 0.05 and with some types of emulsions a reduction of fog of at least 0.10 can be realized.

It is understood that the drying process need not be run under the harsher conditions but the compound incorporation allow flexibility by drying at a lower RH for at least a portion of the drying cycle.

Fog is measured using a Macbeth densitometer model TD-504 manufactured by the Kollmorgen Corporation, Newburgh, N.Y. A film sample, without having been previously exposed to light, is processed in a Du Pont QC1 automatic X-ray film processor (E. I. du Pont de Nemours & Co., Wilmington, Del.) at 95° F. The Macbeth measures fog as $$\text{Macbeth Fog Reading log} = \left(\frac{1}{\text{transmittance}}\right)$$

A measurement of the support without emulsion coating can also be made with the Macbeth. The fog reading of a film sample is the reading of the film sample with unexposed emulsion coating minus the reading of the support alone.

In yet another embodiment of this invention, small amounts of various humectants and plasticizers may be added in addition to the organic alcohols discussed above, in fact it is so preferred. When this is done, even better results are achieved. First, it is possible to reduce the amount of organic alcohol present in the emulsion. Second, good drying characteristics are achieved thus permitting shorter residence times in the dryer without any deleterious for effects. Additionally, the film has greatly reduced propensity to kinking, essentially no drying patterns and excellent surface characteristics. These enhanced characteristics permit films to be handled in automatic changers and the like common in the X-ray industry without causing surface problems which can occur if the emulsion is too soft or pliable. This synergistic affect on overall emulsion characteristics could not have been predicted from a simple knowledge of the prior art which taught the use of some of these compounds in an emulsion as described above.

Plasticizers commonly useful within the ambit of this invention include latex type polymers such as those described in Nottorf, U.S. Pat. No. 3,142,568, the substance of which is incorporated herein by reference. These polymers are generally aqueous polymeric dispersions of acrylic acid esters, alkyl acrylates or methacrylates and the like. We prefer a styrene/butadiene latex although any of the conventional, well known latex polymers will function as well.

Humectants useful within the ambit of this invention are legion in number and include polyols such as trimethylolpropane (preferred), hexanetriol, ethylene glycol, glycerine, 1,4-butanediol, 1,5-pentanediol, 1,6-hexanediol, 1.7-heptanediol, for example.

The aforesaid humectants and plasticizers may be added along with the organic alcohols in very low amounts. For example, all three can be added in amounts comparable to the organic alcohol alone which was previously described.

When all three ingredients are employed within a gelatino, silver halide emulsion, as described above, superior results are achieved. The emulsion can be coated and dried in a shorter length of time without the occurrence of so-called drying fog. There are less kinks and objectionable drying patterns and the final film has excellent surface stability and thus can be handled safely in today's modern, automatic handling systems.

This invention will now be illustrated by the following examples of which Example 1 is considered the best mode:

EXAMPLE 1

A coarse grain, gelatino, silver iodobromide (ca. 2 mol % iodide and ca. 98 mol % bromide) was prepared and bulked with gelatin to a level of 5.5 weight percent of the total emulsion. This was brought to its optimum sensitivity with gold and sulfur. Other, normal adjuvants were also added such as antifoggants, coating and wetting aids, etc. Two samples of this emulsion were taken. The first (The Control) was coated on a conventional polyethylene terephthalate (polyester) film support (7 mils thick, subbed with resin and gelatin and containing a blue, tinting dye) to a silver coating weight of 2.5 g/dm2 and overcoated with a thin, hardened layer of gelatin which acts as an antiabrasion layer. The element was double-side coated on the film support. The total thickness of this layer was about 5 microns. To another sample of this emulsion pure 2-phenoxyethanol (Compound A) was added at a level of 12% by weight of the gelatin present. This sample too was coated and overcoated as described above. Samples of the coated layers were chill set and then dried using an air impingement dryer and the following drying schemes:

| | In Seconds |
|---|---|
| Drying Scheme #1: | |
| Residence Time at 7% Relative Humidity (RH) | 36 |
| Residence Time at 65% RH | 30 |
| Total | 66 |
| Drying Scheme #2: | |
| Residence Time at 7% RH | 60 |
| Residence Time at 65% RH | 6 |
| Total | 66 |
| Drying Scheme #3: | |
| Residence Time at 7% RH | 40 |
| Residence Time at 65% RH | 4 |
| Total | 44 |

Thus both schemes #1 and 2 result in an overall total residence time of 66 seconds. However, Scheme #2 severely overdries the film and exposes the coated emulsion to lower relative humidities for longer time periods. Scheme #3 results in an overall total residence time of 44 seconds showing a reduction of 33% over schemes #1 and #2.

The dried coatings were then tested for various effects such as kinks, fog, drying patterns, fog patterns, etc. The propensity of an element to develop sensitized kinks was determined by obtaining a film sample of 35 mm by 250 mm. The opposite ends of this film strip were combined such that one emulsion layer was positioned on the inside, the other on the outside of the loop formed in this manner. Stress was applied to this film by passing the combined ends of the film loop through a slit of 3 mm in width. The film was then developed, fixed and washed in an automatic film processor at 95° C. (Du Pont QC1 Processor, E. I. Du Pont de Nemours & Co., Wilmington, Del.) in which the total residence time was 90 seconds using a conventional medical X-ray developer and fixer (Du Pont HSD Developer and XMF Fixer). The developed coatings were then measured for density on that portioned blackened by the aforementioned pressure and compared to the portion which received no pressure. The difference in density is that caused by the kink. The films were also checked for total fog and evaluated visually for the various drying and drying fog patterns. The presence of any patchy surface irregularities on undeveloped film, when observed in reflected light, were noted and compared to the presence of higher densities (e.g., fog) in areas of similar patch surface irregularities in the developed films. The results found from these tests are shown below:

TABLE 1

| Sample | Drying Method | Fog | Drying Patterns | Patterns | Sensitized Kink Density |
|---|---|---|---|---|---|
| Control | 1 | .07 | None | None | .07 |
| Cmpd. A | 1 | .05 | None | None | .02 |
| Control | 2 | .19 | Severe | Severe | .04 |
| Cmpd. A | 2 | .08 | None | None | .01 |
| Control | 3 | .13 | Moderate | Moderate | .05 |
| Cmpd. A | 3 | .06 | None | None | .01 |

From these results it can be seen that the addition of a small amount of the high boiling, organic alcohol of this invention to the emulsion will permit harsher drying conditions or higher throughput without deleterious effects on the surface or fogging of the film and without appreciable kinking.

EXAMPLE 2

In this example a silver iodobromide emulsion containing thick, small tabular grains were used. Additionally, a conventional orthchromatic sensitizing dye was added to impart the desired sensitivity to this emulsion. Other sensitizers, coating and wetting aids, antifoggants, etc. were also added as previously described. This emulsion was split into 11 portions. One was kept as a control. To the remaining portions, compounds previously described were added at a level of 12% by weight based on the gelatin present which was ca. 5.5% by weight of the total emulsion present. The various portions were then coated and overcoated as described in Example 1 to a total silver coating weight of 2.3 g/dm2 and a total thickness of about 5 microns. Each of these coatings were then dried using the following method.

| | |
|---|---|
| Residence Time at 30% RH | 50 |
| Residence Time at 65% RH | 70 |
| Total | 120 |

Each of the dried coatings were then tested for the presence of sensitized kinks as described in Example 1 with the following results:

TABLE 2

| Sample | Sensitized Kink Density |
|---|---|
| Contol | .22 |
| Compound A | .12 |
| Compound B | .14 |
| Compound C | .11 |
| Compound D | .16 |
| Compound E | .15 |
| Compound F | .13 |
| Compound G | .14 |
| Compound H | .14 |
| Compound I | .14 |
| Compound J | .08 |

EXAMPLE 3

In yet another test of varying drying conditions, Compound A was added to a cubic grain, silver iodobromide emulsion, which contained 5.5% by weight of gelatin, at a level of 10% by wight after the emulsion had been brought to its optimum sensitivity as previously described. This emulsion, along with a control which did not contain any Compound A, was coated on a polyester film support and overcoated to yield a coating of about 10 microns thick (ca. 4.8 g/dm2 of total silver). Samples were dried under the following drying schemes:

| | Seconds |
|---|---|
| Drying Scheme 4: | |
| Residence Time at 40% RH | 100 |
| Residence Time at 65% RH | 90 |
| Total | 190 |
| Drying Scheme 5: | |
| Residence Time at 40% RH | 34 |
| Residence Time at 15% RH | 43 |
| Residence Time at 65% RH | 15 |
| Total | 91 |

Samples of the dried film were evaluated for kinks, surface defects and fog as described in Example 1 with the following results:

TABLE 3

| Drying | | Drying Fog | | Sensitized | |
|---|---|---|---|---|---|
| Sample | Method | Fog | Patterns | Patterns | Kink Density |
| Control | 4 | .14 | None | None | .08 |
| Cmpd. A | 4 | .08 | None | None | .02 |
| Control | 5 | .14 | Heavy | Heavy | .06 |
| Cmpd. A | 5 | .08 | None | None | .01 |

A comparison of these two drying schemes indicates that the residence time of the coated emulsion in the same dryer under the conditions of Scheme 5 is lower by 50% over Scheme 4.

EXAMPLE 4

A conventional, silver iodobromide emulsion similar to that described in Example 1 was selected for this example. This emulsion contained 5.5% by weight of gelatin and was fully sensitized as previously described. After preparation, this emulsion was split into five portions. Portion 1 (The Control) was coated without further addition. Portion 2 was coated with the addition of 11% by weight of the gelatin present of Compound A. Portion 3 was coated with the addition of 11% by weight of the gelatin present of trimethylolpropane (a plasticizer). Portion 4 was coated with the addition of 11% by weight of the gelatin present of a styrene/-butadiene latex (a humectant). Portion 5 was coated with 3.6% by weight based on the gelatin present of each of Compound A, trimethylolpropane and styrene/butadiene latex. Each coating was dried in an air impingement dryer at 40% RH for 50 seconds, 15% RH for 60 seconds and finally, 65% RH for 20 seconds. Samples of each the dried films were checked for fog with the following results:

TABLE 4

| Sample | Fog |
|---|---|
| Control (Portion 1) | .095 |
| Portion 2 | .043 |
| Portion 3 | .035 |
| Portion 4 | .064 |
| Portion 5 | .050 |

EXAMPLE 5

In addition to reducing drying fog, these binder adjuvants when used together can significantly reduce the impact of other film physical characteristics such as the propensity to stick together at relative high humidity (as measured by the coefficient of friction —COF), reticulation (as measured by surface haze) and high temperature/high relative humidity oven fog. Thus, the COF on samples of each of the films made in Example 4 was measured using a TMI-32 instrument made by Testing Machine, Inc. of 400 Bayview Drive, Amityville, N.Y. 11701.

This machine is designed to test the COF of sliding between two sheets of material. A 200 g load is attached to the top of two sheets. A cable is attached to the load and the top sheet and an electronic force gauge measure the forces required to pull to load at a selected speed. Static COF is equal to the peak force reading at the point when the load starts to move, divided by the weight of the load. The test is conducted in 70–75% RH and can be correlated to film jamming in a commercial, automatic X-ray film feeder (e.g., Schonander).

Reticulation is a defect that can occur when a film is processed in a rapid, commercial film processor. The lateral swelling of the surface of the emulsion layer is sometimes greater than that portion of the layer next to the film base, where it is securely anchored. Surface reticulation, then, can be seen as a surface haze and impart a poor, aesthetic appearance to the finished film. Surface haze in this Example was measured using a Garner Pivotable-Sphere Hazemeter, Model PG5500, manufactured by Gardner Laboratory, Inc. of 5521 Landy Lane, Betheseda, Md. 20014. This hazemeter has a spherical sensor that collects and measures the amount of transmitted light which, in passing through a sample, deviates from the incident beam by any forward scattering. Any deviation of more than 2.5 degrees is considered to be haze. Haze, then is the amount of scattered light divided by the amount of transmitted light. A measurement of a sample's surface haze is obtained by taking a haze measurement which represents the total haze of the sample. The sample is then submerged in a glass chamber filled with a clear oil which has a refractive index approximately the same as the sample. The oil fills in the irregular film surfaces which have occurred due to reticulation. A haze measurement is then taken which represents the internal haze. Surface haze is the difference between the total and internal haze measurements.

To test the film samples for the high temperature/-high relative humidity oven fog test, a 100 sheet bundle of films are heat sealed in a polypropylene, light proof bag and placed in a cardboard box. This box is then placed in an oven at 50° C. and 65% RH for 14 days. The oven fog reading is the difference in the fog reading of the film before and after residence in this oven.

Samples of each of the films made in Example 4 were also processed through a Schonander Film Changer which processes film through at a rate of 2 sheets per second. The following ratings were determined A—no problems encountered after transporting 1000 sheets of film B—film jammed after transporting 400 sheets of film C—film jammed after transporting 200 sheets of film

TABLE 5

| | Surface Haze | | | Schonander |
|---|---|---|---|---|
| Sample | Static COF | (%) | Oven Fog | Changer |
| Control (Portion 1) | .302 | 6.8 | .08 | A |
| Portion 2 | .403 | 10.6 | .28 | B |
| Portion 3 | .625 | 7.8 | .20 | C |
| Portion 5 | .304 | 8.3 | .12 | A |

As can be seen in Examples 4 and 5 a combination of high boiling, organic alcohol, a plasticizer and a humectant, according to the teachings of this invention, will yield a photographic element which can be coated under severe drying conditions yet will give low drying fog, good resistance to surface haze, low oven fog and will process with excellent results in the modern, automatic changing devices. This is an exceptional result for it will permit rapid drying of commercially prepared photographic film elements with none of the aforesaid defects.

What is claimed is:

1. In a process for the manufacture of a photosensitive element having at least one photosensitive gelatino silver halide emulsion coated on a support, said element is subjected to elevated temperature to effect drying, wherein the improvement comprises the addition into said emulsion before said drying step of a humectant, a plasticizer, and a high boiling organic alcohol compound wherein the compound is an aromatic alcohol of the formula

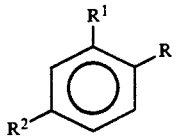

wherein R is —O—$CH_2$—$CH_2$—O—$R^4$, with $R^4$ being H; —$CH_2$—$CH_2$—OH; —$CH_2$—$CH_2$—O—$CH_2$—OH; or R is —O—Phenyl—OH, —$OCH_2$ CHOH $CH_2$ OH, or —O—$(CH_2)_4$—$CH_3$; $R^1$ is H or —O—$CH_3$; and $R^2$ is —OH or —$CH_3$;

phenoxy-2-propanone;

2-methoxyethanol;

2-ethoxyethanol;

2-phenoxyethanol;

2-(2-phenoxyethoxy) ethanol;

2-[2-(2-phenoxyethoxy)-ethoxy] ethanol;

3-phenoxy-1,2-propanediol;

p-phenoxybenzyl alcohol; m-phenoxybenzyl or 2-hydroxyethyl salicylate and wherein the humectant is trimethylol-propane; hexanetriol; ethylene glycol; glycerine; 1,4-butanediol; 1,5-pentanediol; 1,6-hexanediol or 1,7-heptanediol with the proviso that at least 50% by weight of water within the emulsion is removed at a relative humidity within a range from 5 to 30% wherein a film element with reduced surface artifacts is produced.

2. The process of claim 1 wherein said high boiling organic alcohol compound is selected from the group consisting of 2-phenoxyethanol; 2-(2-phenoxyethoxy) ethanol; 2-[2-(2-phenoxyethoxy)-ethoxy] ethanol; 3-phenoxy-1,2-propanediol; m-phenoxybenzyl alcohol; p-phenoxybenzyl alcohol; phenoxy-2-propanone; 2-methoxyethanol; 2-ethoxyethanol; and 2-hydroxyethyl salicylate.

3. The process of claim 1 wherein said high boiling organic alcohol compound is added to said emulsion in a range of 1 to 50% by weight, based on the total gelatin present therein.

4. The process of claim 1 wherein said drying removes at least 90% by weight water.

* * * * *